US007613314B2

(12) United States Patent
Camp, Jr.

(10) Patent No.: US 7,613,314 B2
(45) Date of Patent: Nov. 3, 2009

(54) MOBILE TERMINALS INCLUDING COMPENSATION FOR HEARING IMPAIRMENT AND METHODS AND COMPUTER PROGRAM PRODUCTS FOR OPERATING THE SAME

(75) Inventor: William O. Camp, Jr., Chapel Hill, NC (US)

(73) Assignee: Sony Ericsson Mobile Communications AB, Lund (SE)

( * ) Notice: Subject to any disclaimer, the term of this patent is extended or adjusted under 35 U.S.C. 154(b) by 1044 days.

(21) Appl. No.: 10/977,713

(22) Filed: Oct. 29, 2004

(65) Prior Publication Data

US 2006/0094981 A1 May 4, 2006

(51) Int. Cl.
*H04R 25/00* (2006.01)

(52) U.S. Cl. ..... 381/315; 381/60; 381/312

(58) Field of Classification Search ..... 381/60, 381/77, 312

See application file for complete search history.

(56) References Cited

U.S. PATENT DOCUMENTS 6,115,478 A * 9/2000 Schneider ..... 381/314
7,190,795 B2 * 3/2007 Simon ..... 381/60
7,388,962 B2 * 6/2008 Cheung et al. ..... 381/381
2003/0064746 A1 * 4/2003 Rader et al. ..... 455/550

FOREIGN PATENT DOCUMENTS

GB 2 394 632 A 4/2004
WO WO 2004/093488 A 10/2004

OTHER PUBLICATIONS

International Search Report and Written Opinion of the International Searching Authority for International patent application No. PCT/US2005/014527 mailed on Sep. 15, 2005.
Invitation to Pay Additional Fees and Partial International Search Report for International application No. PCT/US2005/014527 mailed on Jul. 25, 2005.
Partial European Search Report for Application No. 05 740 081.4-2225; Sep. 4, 2007.

* cited by examiner

*Primary Examiner*—Suhan Ni
*Assistant Examiner*—Jasmine Pritchard
(74) *Attorney, Agent, or Firm*—Myers Bigel Sibley & Sajovec, P.A.

(57) ABSTRACT

A mobile terminal includes a processor that is programmed to provide a user of the mobile terminal with a hearing test and to determine a set of coefficients. A microphone is configured to receive audio signals therethrough. A digital filter is programmed with the determined set of coefficients and is configured to process the audio signals and transmit the processed audio signals to an earphone.

18 Claims, 4 Drawing Sheets

MOBILE TERMINALS INCLUDING COMPENSATION FOR HEARING IMPAIRMENT AND METHODS AND COMPUTER PROGRAM PRODUCTS FOR OPERATING THE SAME

BACKGROUND OF THE INVENTION

The present invention relates to electronic devices and methods of operating the same, and, more particularly, to electronic devices that can be used to assist persons with a hearing impairment and methods of operating the same.

The gradual loss of hearing that occurs as a person ages is a relatively common condition. An estimated one-third of Americans older than age 60 and one-half of those older than age 75 have a hearing impairment. Over time, noise may contribute to hearing loss by damaging the cochlea, which is a part of the inner ear. Other factors, such as blockage due to earwax, may reduce the ability of the ear to detect certain sounds or frequencies. In general, inner ear damage cannot be reversed. An audiologist, however, may be able to fit a person experiencing hearing loss with a hearing aid, which may improve the person's hearing. In fact, most of the hearing aids in the United States are dispensed and fitted by audiologists using advanced computerized procedures and state-of-the art equipment to individualize their fittings. Unfortunately, while a hearing aid fitted by an audiologist may be effective in improving a person's hearing, such a hearing aid may be relatively expensive, may be expensive to maintain and adjust, and may also have an unacceptable appearance. It is estimated that between five and fifteen million Americans should be using a hearing aid, but do not. Thus, there exists a need for devices that can improve the hearing of those who are hearing impaired at a reasonable cost.

SUMMARY OF THE INVENTION

In some embodiments of the present invention, a mobile terminal comprises a processor that is programmed to provide a user of the mobile terminal with a hearing test and to determine a set of coefficients. A microphone is configured to receive audio signals therethrough. A digital filter is programmed with the determined set of coefficients and is configured to process the audio signals and transmit the processed audio signals to an earphone.

In other embodiments of the present invention, the digital filter is further configured to process the audio signals by adjusting the gain of the audio signals based on frequency and/or power level, compressing the audio signals based on frequency and/or power level, and/or expanding the audio signals based on frequency and/or power level.

In still other embodiments of the present invention, the digital filter comprises a plurality of digital filters that are programmed with the determined set of coefficients and are configured to process the audio signals and transmit the processed audio signals to the earphone.

In still other embodiments of the present invention, the set of coefficients is a first set of coefficients, the microphone comprises a pair of microphones, and the processor is further programmed to determine a second set of coefficients based on training audio signals received through the pair of microphones when the microphones are placed in a plurality of orientations. The digital filter is programmed with the determined first and second set of coefficients.

In still other embodiments of the present invention, the processor is programmed to generate a hearing sensitivity curve based on the hearing test and to determine the set of coefficients based on a Least Mean Square (LMS) fit to an inverse of the hearing sensitivity curve.

In still other embodiments of the present invention, the mobile terminal further comprises an interface for communicating the set of coefficients to an electronic device.

In further embodiments of the present invention, a mobile terminal comprises a processor that is programmed to provide a user of the mobile terminal with a hearing test and to determine a set of coefficients. A radio frequency air interface is configured to receive audio signals therethrough. A digital filter is programmed with the determined set of coefficients and is configured to process the audio signals and transmit the processed audio signals to an earphone.

In other embodiments of the present invention, a mobile terminal comprises a pair of microphones. A processor is programmed to determine a set of coefficients based on training audio signals received through the pair of microphones when the microphones are placed in a plurality of orientations.

Although described above primarily with respect to apparatus, i.e., mobile terminal aspects of the present invention, it will be understood that the present invention may be embodied as mobile terminals, methods, and/or computer program products.

DETAILED DESCRIPTION OF EXEMPLARY EMBODIMENTS

Figure 1:
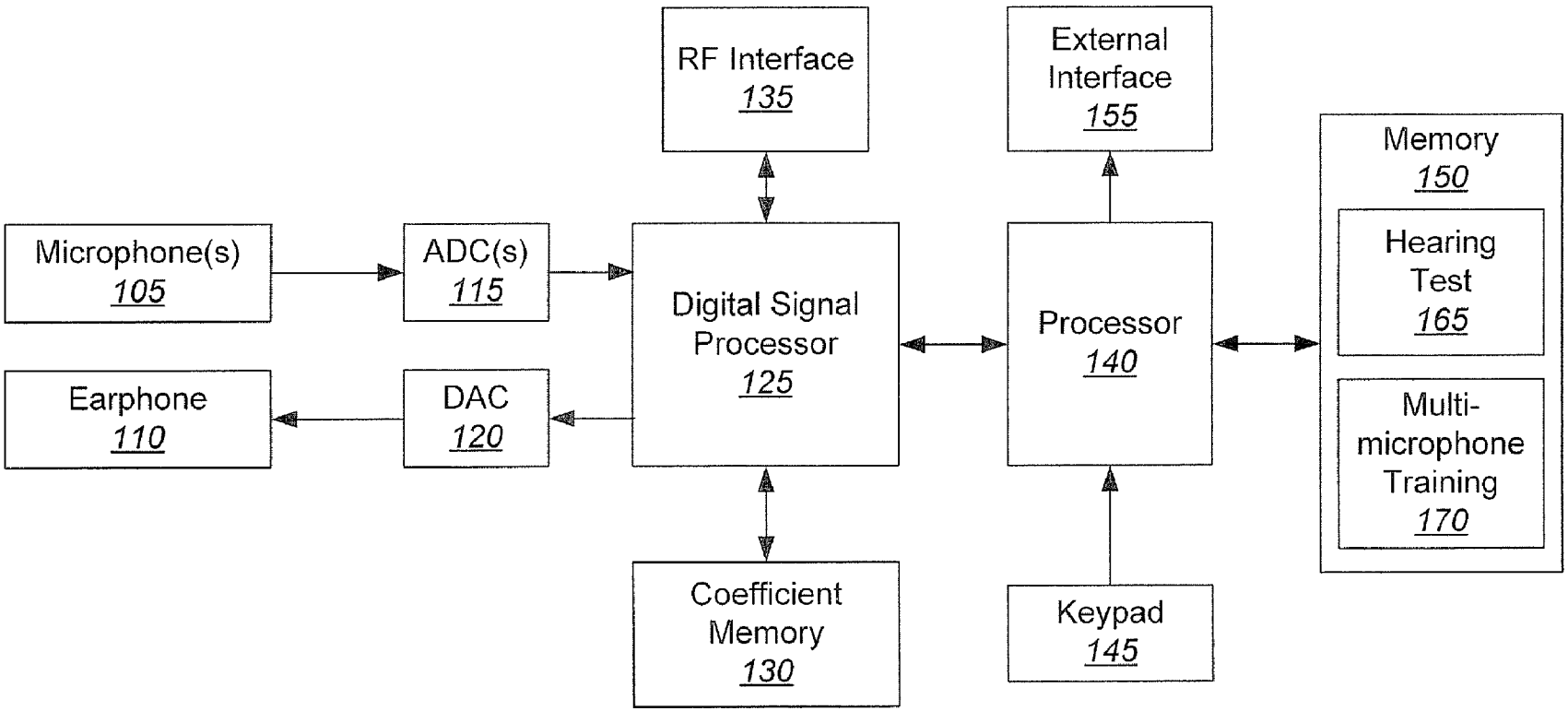
FIG. 1 is a block diagram of a mobile terminal that includes compensation for users of the mobile terminal with hearing impairment in accordance with some embodiments of the present invention.

Specific exemplary embodiments of the invention now will be described with reference to the accompanying drawings. This invention may, however, be embodied in many different forms and should not be construed as limited to the embodiments set forth herein; rather, these embodiments are provided so that this disclosure will be thorough and complete, and will fully convey the scope of the invention to those skilled in the art. The terminology used in the detailed description of the particular exemplary embodiments illustrated in the accompanying drawings is not intended to be limiting of the invention. In the drawings, like numbers refer to like elements.

As used herein, the singular forms "a," "an," and "the" are intended to include the plural forms as well, unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that when an element is referred to as being "connected" or "coupled" to another element, it can be directly connected or coupled to the other element or intervening elements may be present. Furthermore, "connected" or "coupled" as used herein may include wirelessly connected or coupled. As used herein, the term "and/or" includes any and all combinations of one or more of the associated listed items.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

The present invention may be embodied as methods, mobile terminals, and/or computer program products. Accordingly, the present invention may be embodied in hardware and/or in software (including firmware, resident software, micro-code, etc.). Furthermore, the present invention may take the form of a computer program product on a computer-usable or computer-readable storage medium having computer-usable or computer-readable program code embodied in the medium for use by or in connection with an instruction execution system. In the context of this document, a computer-usable or computer-readable medium may be any medium that can contain, store, communicate, propagate, or transport the program for use by or in connection with the instruction execution system, apparatus, or device.

The computer-usable or computer-readable medium may be, for example but not limited to, an electronic, magnetic, optical, electromagnetic, infrared, or semiconductor system, apparatus, device, or propagation medium. More specific examples (a nonexhaustive list) of the computer-readable medium would include the following: an electrical connection having one or more wires, a portable computer diskette, a random access memory (RAM), a read-only memory (ROM), an erasable programmable read-only memory (EPROM or Flash memory), an optical fiber, and a compact disc read-only memory (CD-ROM). Note that the computer-usable or computer-readable medium could even be paper or another suitable medium upon which the program is printed, as the program can be electronically captured, via, for instance, optical scanning of the paper or other medium, then compiled, interpreted, or otherwise processed in a suitable manner, if necessary, and then stored in a computer memory.

As used herein, the term "mobile terminal" may include a satellite or cellular radiotelephone with or without a multiline display; a Personal Communications System (PCS) terminal that may combine a cellular radiotelephone with data processing, facsimile and data communications capabilities; a PDA that can include a radiotelephone, pager, Internet/intranet access, Web browser, organizer, calendar and/or a global positioning system (GPS) receiver; and a conventional laptop and/or palmtop receiver or other appliance that includes a radiotelephone transceiver. Mobile terminals may also be referred to as "pervasive computing" devices.

Some embodiments of the present invention stem from a realization that many people suffer from at least some form of hearing impairment, but conventional hearing aids may be too expensive, may be too expensive to maintain/adjust, and/or may be aesthetically unacceptable. According to some embodiments of the present invention, existing hardware and/or software in a mobile terminal may be enhanced to serve as a hearing aid for those users with a hearing impairment. In some embodiments, the mobile terminal may provide a user with a hearing test, which is then used to tune the mobile terminal to adapt to the user's hearing abilities. As a person's hearing changes over time, the test can be re-taken to update the mobile terminal with the user's new hearing profile. Mobile terminals, such as cellular phones, have become an accepted appearance feature throughout the world. Thus, users may find the use of a mobile terminal, according to some embodiments of the present invention, more aesthetically pleasing than a conventional hearing aid.

Referring now to FIG. 1, a mobile terminal 100 that includes compensation for users of the mobile terminal 100 with hearing impairment, in accordance with some embodiments of the present invention, comprises one or more microphones 105 and an earphone 110 that are associated therewith. The microphone(s) 105 and the earphone 110 are coupled to one or more analog-to-digital converters 115 and a digital-to-analog converter 120, respectively. The interface between the microphone(s) 105 and the earphone 110 and the mobile terminal 100 may be a wireless interface, such as a Bluetooth interface, to provide hands-free operation, for example, or a wire interface may be used in accordance with various embodiments of the present invention. The mobile terminal 100 further comprises a digital signal processor 125 that is coupled to a coefficient memory 130. The digital signal processor 125 is also coupled to a radio frequency air interface 135 for providing access to a wireless communications network, for example. The digital signal processor 125 may comprise one or more adaptive digital filters, such as finite impulse response (FIR) filters. Because improvement in hearing generally results from acoustic processing that is dependent on signal level as well as frequency, the digital signal processor 125 may comprise a series or combination of digital filters whose outputs may be sorted according to frequency and/or amplitude and recombined in further filters to achieve the desired results.

Figure 2:
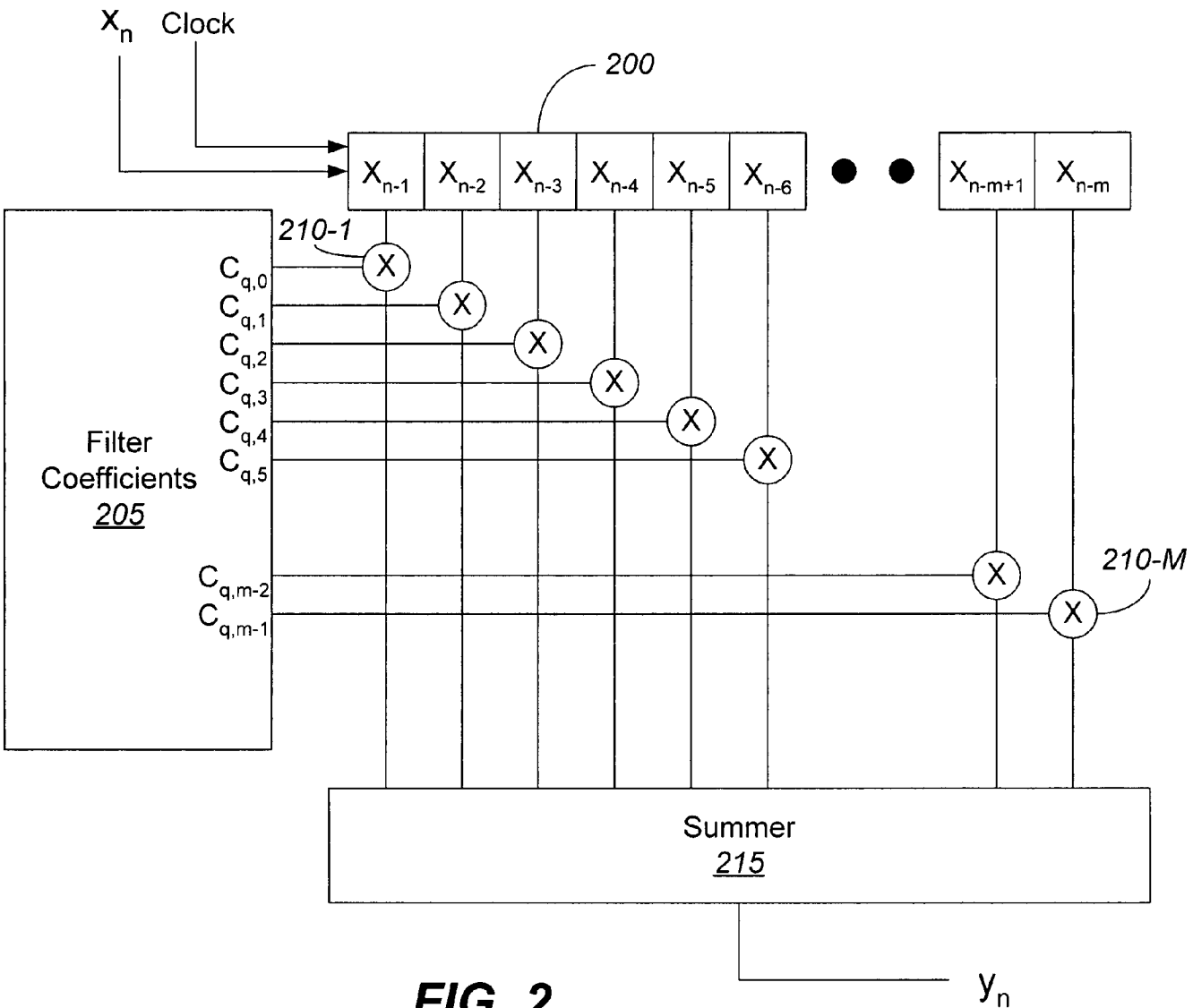
FIG. 2 is a block diagram of a digital filter architecture for use in the mobile terminals of FIG. 1 in accordance with some embodiments of the present invention.

FIG. 2 shows the general stricture of an adaptive FIR filter. The operation of an FIR digital filter can generally be represented by Equation 1 set forth below:

$$Y_n = \sum_{k=1}^{k=m} C_k^n X_{n-k} \qquad \text{EQ. 1}$$

where $Y_n$ is the output at time n, $C_k^n$ is the $k^{th}$ coefficient at time n and $X_{n-k}$ is the input at time n-k. Typically, the collection of samples $X_{n-1}$ through $X_{n-m}$ is stored in a tapped delay line 200. The characteristics of the filter are determined by the values of the coefficients 205 at time n. Each coefficient is also called a tap weight or tap coefficient. The coefficients 205 correspond to the coefficients stored in the coefficient memory 130 of FIG. 1. Each coefficient, $C_k^n$, is used to multiply the respective sample of X(t) through a corresponding multiplier 210-*i* with the result that $Y_n$ is equal to the sum of the products of the coefficients and the respective m samples of X(t), which is output from a summer 215. This approach of generating output samples $Y_n$ based on a weighted summation of prior-in-time input samples combats the effects of noise, attenuation, and inter-symbol interference (ISI) due to delay, distortion, and/or other impairments of a communications channel.

Returning to FIG. 1, the mobile terminal 100 further comprises a microprocessor 140 that is coupled to a keypad 145 for obtaining input from a user. The microprocessor 140 is further coupled to a memory 150 and an external interface 155 for communicating with other electronic devices. In accordance with some embodiments of the present invention, the memory 150 is configured with a hearing test program 165, which may be executed by the microprocessor 140 to provide a user of the mobile terminal 100 with a hearing test and to determine a set of coefficients for one or more filters comprising the digital signal processor 125 based on the hearing test as will be described further below. The memory 150 is also configured with a multi-microphone training program 170, which may be executed by the microprocessor 140 to determine a set of coefficients for one or more filters comprising the digital signal processor 125 to combine the two signals from the multiple microphones 105 with gain and phase adjustments to form a directional acoustic beam pattern.

Although FIG. 1 illustrates an exemplary software and hardware architecture that may be used in a mobile terminal to compensate for a user's hearing impairment, it will be understood that the present invention is not limited to such a configuration but is intended to encompass any configuration capable of carrying out the operations described herein.

Computer program code for carrying out operations of the hearing test program 165 and the multi-microphone training program 170 discussed above may be written in a high-level programming language, such as C or C++, for development convenience. In addition, computer program code for carrying out operations of embodiments of the present invention may also be written in other programming languages, such as, but not limited to, interpreted languages. Some modules or routines may be written in assembly language or even microcode to enhance performance and/or memory usage. It will be further appreciated that the functionality of any or all of the program and/or processing modules may also be implemented using discrete hardware components, one or more application specific integrated circuits (ASICs), or a programmed digital signal processor or microcontroller.

The present invention is described hereinafter with reference to flowchart and/or block diagram illustrations of methods, mobile terminals, and computer program products in accordance with some embodiments of the invention. These flowchart and/or block diagrams further illustrate exemplary operations of the mobile terminal and digital signal processor architectures of FIGS. 1 and 2. It will be understood that each block of the flowchart and/or block diagram illustrations, and combinations of blocks in the flowchart and/or block diagram illustrations, may be implemented by computer program instructions and/or hardware operations. These computer program instructions may be provided to a processor of a general purpose computer, a special purpose computer, or other programmable data processing apparatus to produce a machine, such that the instructions, which execute via the processor of the computer or other programmable data processing apparatus, create means for implementing the functions specified in the flowchart and/or block diagram block or blocks.

These computer program instructions may also be stored in a computer usable or computer-readable memory that may direct a computer or other programmable data processing apparatus to function in a particular manner, such that the instructions stored in the computer usable or computer-readable memory produce an article of manufacture including instructions that implement the function specified in the flowchart and/or block diagram block or blocks.

The computer program instructions may also be loaded onto a computer or other programmable data processing apparatus to cause a series of operational steps to be performed on the computer or other programmable apparatus to produce a computer implemented process such that the instructions that execute on the computer or other programmable apparatus provide steps for implementing the functions specified in the flowchart and/or block diagram block or blocks.

Figure 3:
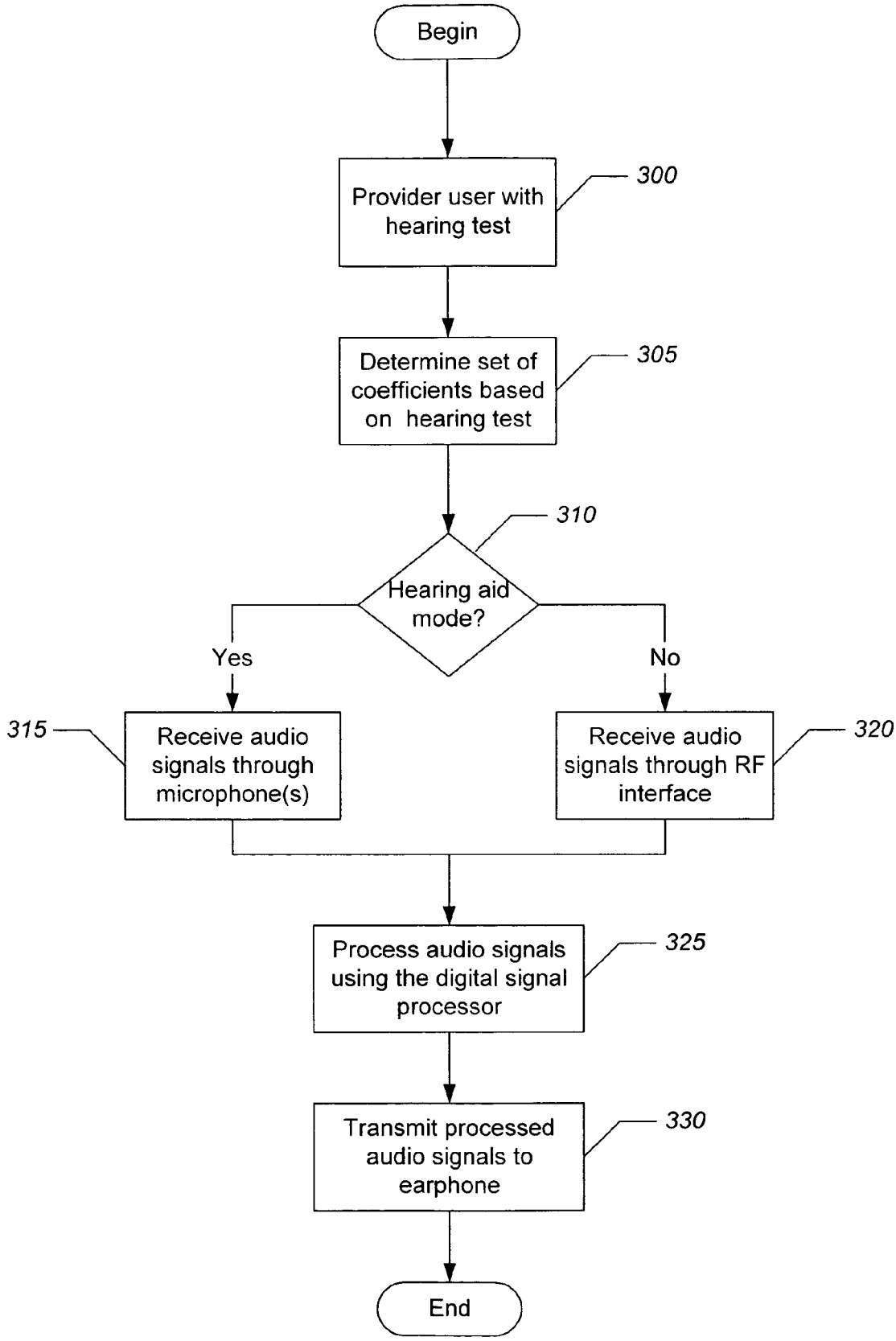
FIGS. 3 and 4 are flowcharts that illustrate operations of a mobile terminal that includes compensation for a user of the mobile terminal with hearing impairment in accordance with some embodiments of the present invention.

Referring now to FIG. 3 and with frequent reference to FIG. 2, exemplary operations of a mobile terminal that includes compensation for a user of the mobile terminal with hearing impairment, in accordance with some embodiments of the present invention, begin with the processor 140 executing the hearing test program 165 to provide the user of the mobile terminal with a hearing test (block 300). The hearing test program 165 may provide the user with a series of tones, sounds, and/or words at varying sound levels, which the user may respond to via the keypad 145. Advantageously, a user may self-administer the hearing test anytime to provide the mobile terminal with an updated profile of the user's hearing ability.

The hearing test program 165 then determines a set of coefficients for the one or more digital filters comprising the digital signal processor 125 based on the results of the hearing test (block 305). The determined coefficients are stored in the coefficient memory 130. In accordance with some embodiments of the present invention, the hearing test program 165 may generate a hearing sensitivity curve based on the hearing test and determine the set of coefficients based on a Least Mean Square (LMS) fit to an inverse of the hearing sensitivity curve.

As discussed above, the mobile terminal may have multiple microphones 105 in accordance with some embodiments of the present invention. If the mobile terminal is configured with a pair of microphones 105, for example, then, referring now to FIG. 4, operations for generating additional coefficients for the one or more filters comprising the digital signal processor 125 begin the user placing the pair of microphones 105 in a plurality of orientations (block 400). The multi-microphone training program 170 receives training audio signals through the pair of microphones 105 in each of the plurality of positions (block 405). Moreover, the user may enter a response using the keypad of the mobile terminal to indicate whether the sound is coming from a desired direction or an undesired direction. The multi-microphone training program 170 determines a set of coefficients for the one or more filters comprising the digital signal processor 125 based on the received training audio signals and the user's keypad input (block 410). These coefficients determined by the multi-microphone training program 170 are stored in the coefficient memory 130 and may be used to combine signals from the pair of microphones 105 with gain and phase adjustments so as to form a directional acoustic beam pattern. Advantageously, this may allow a user to enhance the acoustic signal from in front of the user and to suppress the user's own voice and noises from in back of the user.

Returning to FIG. 3, if the mobile terminal is operating in a hearing aid mode (block 310), then audio signals are received through the microphone(s) 105 associated with the mobile terminal (block 315). Otherwise, if the mobile terminal is operating as a mobile communications device, then the audio signals are received through the radio frequency air interface 135 (block 320). The received audio signals are then processed using the digital filters comprising the digital signal processor 125, which is programmed with the coefficients determined by the hearing test program 165 and, if applicable, the coefficients determined by the multi-microphone training program 170 (block 325). In some embodiments, such processing by the one or more filters comprising the digital signal processor 125 may involve processing the audio signals by adjusting the gain of the audio signals based on frequency and/or power level, compressing the audio signals based on frequency and/or power level, and/or expanding the audio signals based on frequency and/or power level. The digital signal processor 125 then transmits the processed audio signals to the earphone 110 associated with the mobile terminal (block 330).

The coefficients stored in the coefficient memory 130 in combination with the digital signal processor 125 may provide compensation for a person's particular hearing impairment. A user may wish to use this compensation profile in one or more other electronic devices that he or she owns. Thus, in some embodiments of the present invention, the coefficients stored in the coefficient memory 130 may be communicated to another electronic device via the external interface 155 and/or via the radio frequency air interface 135. Moreover, the coefficients may be used to adjust and/or configure a conventional hearing aid.

Figure 4:
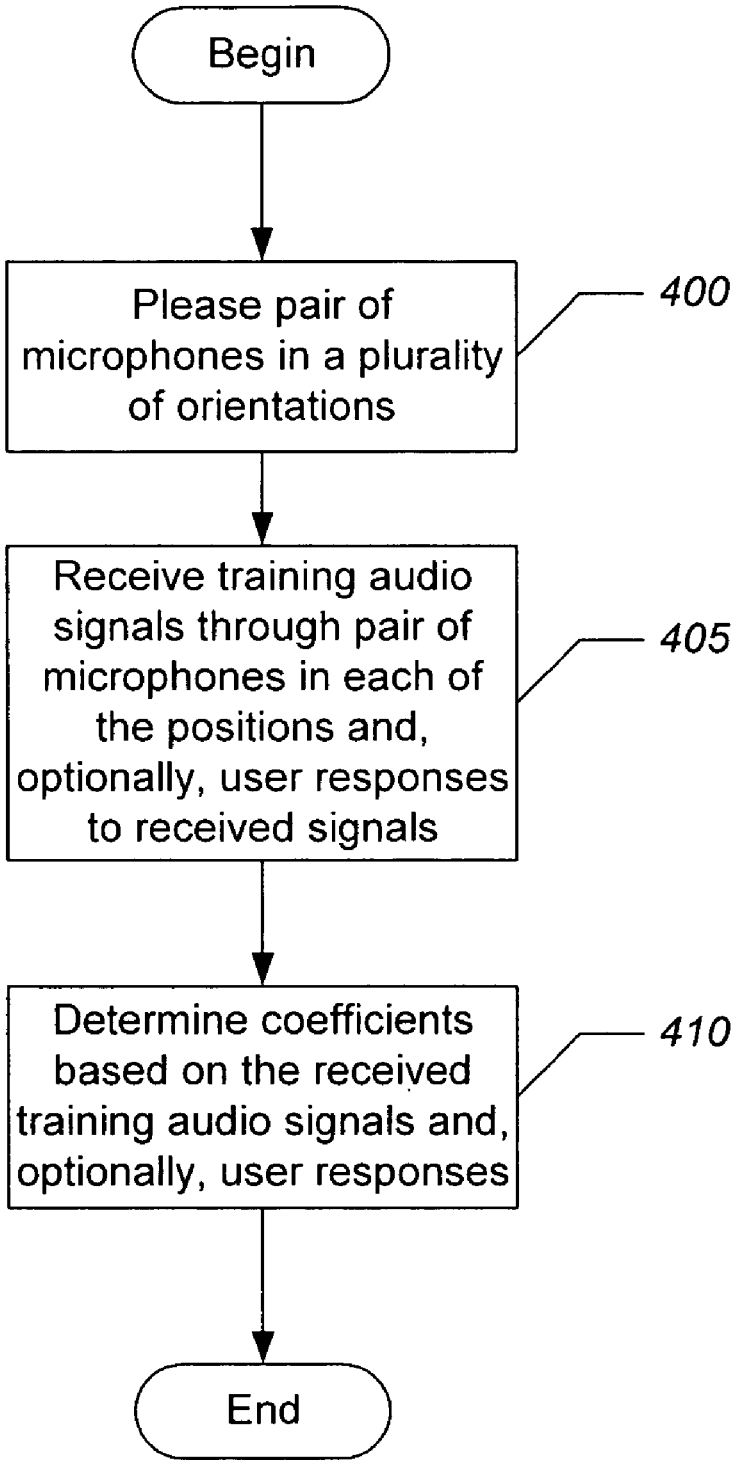

The flowcharts of FIGS. 3 and 4 illustrate the architecture, functionality, and operations of embodiments of the mobile terminal 100 hardware and/or software. In this regard, each block represents a module, segment, or portion of code, which comprises one or more executable instructions for implementing the specified logical function(s). It should also be noted that in other implementations, the function(s) noted in the blocks may occur out of the order noted in FIGS. 3 and 4. For example, two blocks shown in succession may, in fact, be executed substantially concurrently or the blocks may sometimes be executed in the reverse order, depending on the functionality involved.

In the drawings and specification, there have been disclosed exemplary embodiments of the invention. Although specific terms are used, they are used in a generic and descriptive sense only and not for purposes of limitation, the scope of the invention being defined by the following claims.

That which is claimed:

1. A method of operating a mobile terminal that has a pair of microphones associated therewith, comprising:

providing a user of the mobile terminal with a hearing test;

determining a first set of coefficients for a digital filter based on the results of the hearing test;

placing the pair of microphones in a plurality of orientations;

receiving training audio signals through the pair of microphones in each of the plurality of orientations; and determining a second set of coefficients for the digital filter based on the received training audio signals;

receiving audio signals;

processing the audio signals using the digital filter programmed with the determined first and second set of coefficients; and transmitting the processed audio signals to an earphone associated with the mobile terminal.

2. The method of claim 1, wherein processing the audio signals comprises:

processing the audio signals by adjusting the gain of the audio signals based on frequency and/or power level, compressing the audio signals based on frequency and/or power level, and/or expanding the audio signals based on frequency and/or power level.

3. The method of claim 1, further comprising:

using a wireless interface between the microphone and the mobile terminal; and using the wireless interface between the earphone and the mobile terminal.

4. The method of claim 3, wherein the wireless interface is a Bluetooth interface.

5. The method of claim 1, further comprising:

using a wire interface between the microphone and the mobile terminal; and using a wire interface between the earphone and the mobile terminal.

6. The method of claim 1, wherein determining the first and second set of coefficients for the digital filter comprises determining the first and second set of coefficients for a plurality of digital filters, and wherein processing the audio signals using the digital filter comprises processing the audio signals using the plurality of digital filters programmed with the determined first and second set of coefficients.

7. The method of claim 1, further comprising:

receiving user input responsive to receiving the training radio signals through the pair of microphones in each of the plurality of orientations; and wherein determining the second set of coefficients comprises determining the second set of coefficients based on the received training audio signals and the user input.

8. The method of claim 1, wherein determining the set of coefficients comprises:

generating a hearing sensitivity curve based on the hearing test; and determining the first set of coefficients based on a Least Mean Square (LMS) fit to an inverse of the hearing sensitivity curve.

9. The method of claim 1, further comprising:

communicating the first and second set of coefficients to an electronic device.

10. A mobile terminal, comprising:

a pair of microphones;

a processor that is programmed to provide a user of the mobile terminal with a hearing test and to determine a first set of coefficients and to determine a second set of coefficients based on training audio signals received through the pair of microphones when the microphones are placed in a plurality of orientations;

an earphone; and a digital filter that is programmed with the determined first and second set of coefficients and is configured to process the received audio signals and transmit the processed audio signals to the earphone.

11. The mobile terminal of claim 10, wherein the digital filter is further configured to process the received audio signals by adjusting the gain of the audio signals based on frequency and/or power level, compressing the audio signals based on frequency and/or power level, and/or expanding the audio signals based on frequency and/or power level.

12. The mobile terminal of claim 10, wherein the digital filter comprises a plurality of digital filters that are programmed with the determined first and second set of coefficients and are configured to process the received audio signals and transmit the processed audio signals to the earphone.

13. The mobile terminal of claim 10, wherein the processor is further configured to receive user input responsive to the user receiving the training radio signals through the pair of microphones in each of the plurality of orientations and to determine the second set of coefficients based on the received training audio signals and the user input.

14. The mobile terminal of claim 10, wherein the processor is programmed to determine the first set of coefficients by generating a hearing sensitivity curve based on the hearing test and to determine the set of coefficients based on a Least Mean Square (LMS) fit to an inverse of the hearing sensitivity curve.

15. The mobile terminal of claim 10, further comprising:

an interface for communicating the first and second set of coefficients to an electronic device.

16. A computer program product for operating a mobile terminal that has a pair of microphones associated therewith, comprising:

a computer readable storage medium having computer readable program code embodied therein, the computer readable program code comprising:

computer readable program code configured to provide a user of the mobile terminal with a hearing test;

computer readable program code configured to determine a first set of coefficients for a digital filter based on the results of the hearing test;

computer readable program code configured to place the pair of microphones in a plurality of orientations;

computer readable program code configured to receive training audio signals through the pair of microphones in each of the plurality of orientations; and computer readable program code configured to determine a second set of coefficients for the digital filter based on the received training audio signals;

computer readable program code configured to receive audio signals;

computer readable program code configured to process the audio signals using the digital filter programmed with the determined first and second set of coefficients; and computer readable program code configured to transmit the processed audio signals to an earphone associated with the mobile terminal.

17. The method of claim 1, wherein receiving the audio signals comprises receiving the audio signals through the pair of microphones.

18. The mobile terminal of claim 10, wherein the pair of microphones is configured to receive the audio signals therethrough.

* * * * *

UNITED STATES PATENT AND TRADEMARK OFFICE

CERTIFICATE OF CORRECTION

PATENT NO. : 7,613,314 B2
APPLICATION NO. : 10/977713
DATED : November 3, 2009
INVENTOR(S) : William O. Camp, Jr.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1405 days.

Signed and Sealed this

Nineteenth Day of October, 2010

David J. Kappos

David J. Kappos
*Director of the United States Patent and Trademark Office*